US006769581B2

(12) United States Patent
Rogers et al.

(10) Patent No.: US 6,769,581 B2
(45) Date of Patent: Aug. 3, 2004

(54) AUTOMATIC LOCKING HOLSTER

(75) Inventors: William H. Rogers, Jacksonville, FL (US); Norman E. Clifton, Jr., Jacksonville, FL (US)

(73) Assignee: Safariland Ltd., Inc., Ontario, CA (US)

( * ) Notice: Subject to any disclaimer, the term of this patent is extended or adjusted under 35 U.S.C. 154(b) by 99 days.

(21) Appl. No.: 10/058,564

(22) Filed: Jan. 28, 2002

(65) Prior Publication Data

US 2002/0100780 A1 Aug. 1, 2002

Related U.S. Application Data

(63) Continuation-in-part of application No. 09/770,710, filed on Jan. 26, 2001.

(51) Int. Cl.[7] ..... F41C 33/02

(52) U.S. Cl. ..... 224/243; 224/193; 224/238; 224/911

(58) Field of Search ..... 224/193, 238, 224/243, 244, 911, 912

(56) References Cited

U.S. PATENT DOCUMENTS 3,420,420 A * 1/1969 Clark ..... 224/243
5,094,376 A * 3/1992 Baruch ..... 224/243
5,501,381 A * 3/1996 Rogers et al. ..... 224/243
5,944,239 A * 8/1999 Rogers et al. ..... 224/193
6,085,951 A * 7/2000 Beletsky et al. ..... 224/243
6,267,279 B1 * 7/2001 Matthews ..... 224/243
6,371,341 B1 * 4/2002 Clifton, Jr. ..... 224/243

* cited by examiner

*Primary Examiner*—Stephen K. Cronin
(74) *Attorney, Agent, or Firm*—Arthur G. Yeager

(57) ABSTRACT

A holster includes a quick release withdrawal restraint and is constructed of an inner and outer sidewall joined together along a front and back to define an inner cavity with an open top shaped to fit a handgun. The quick restraint includes a mechanical blocking element located in the inner cavity to engage a portion of the handgun adjacent the ejection port to inhibit withdrawal upwardly prior to rearward movement of the handgun. A second mechanical blocking element is also provided adjacent the rear of the trigger guard that is biased into a first position to prevent rearward movement of the gun and a second position that allows for rearward movement of a gun when the second blocking element is moved by pressure on a thumb or finger ledge. A third mechanical blocking element is provided to prevent motion of a handgun when holstered in a manner to cause movement of the second blocking element from the first position.

20 Claims, 9 Drawing Sheets

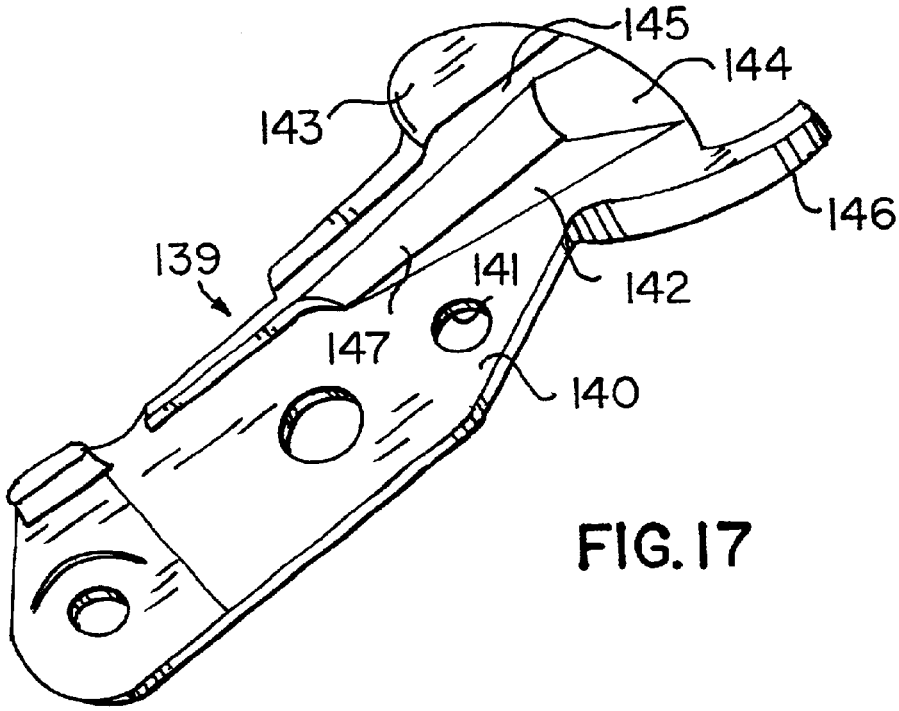
FIG. 17
FIG. 16
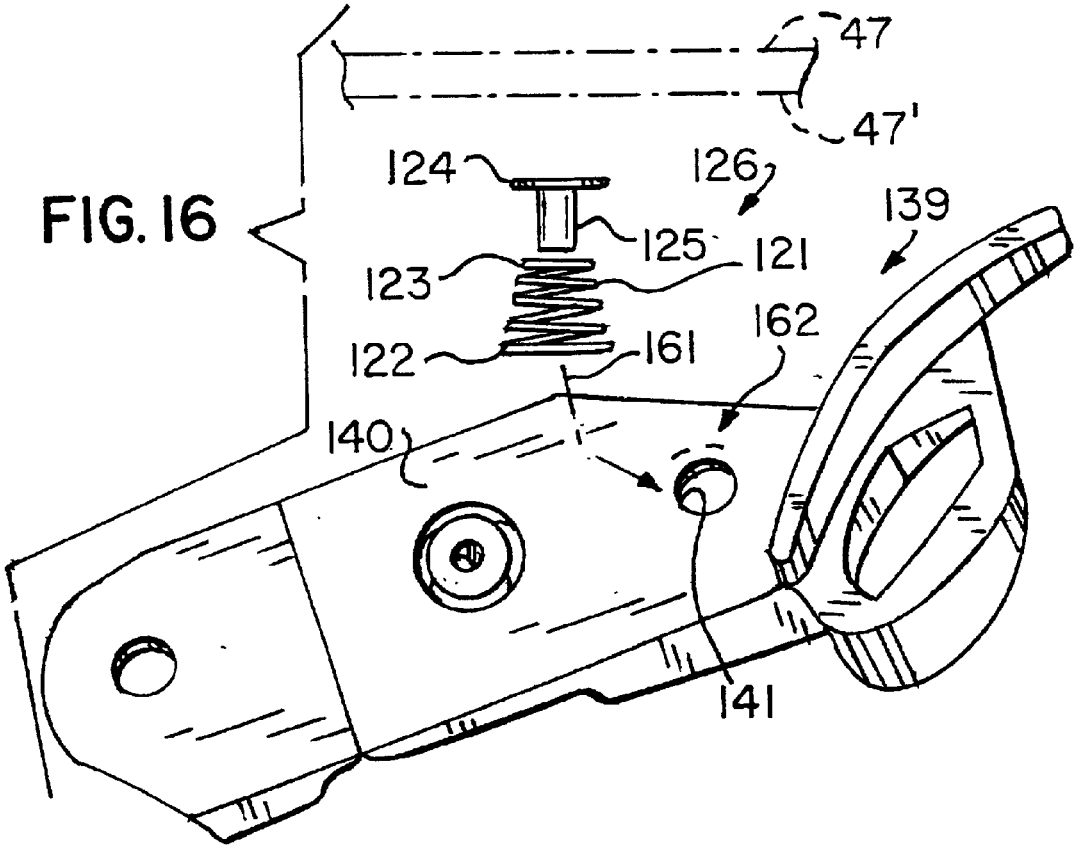

AUTOMATIC LOCKING HOLSTER

CROSS REFERENCE TO RELATED APPLICATIONS

This application is related to an application entitled "RELEASABLE BLOCK FOR ROTATING HOOD HOLSTER" Ser. No. 09/562,085, filed by Norman E. Clifton, Jr. on Apr. 27, 2000; and an application entitled "SUPPORT PLATE FOR A HOLSTER", Ser. No. 09/696,561, filed by William H. Rogers and Norman E. Clifton, Jr. on Oct. 25, 2000; and is a continuation-in-part of an application entitled, "AUTOMATIC LOCKING HOLSTER", Ser. No. 09/770,710, filed by William H. Rogers and Norman E. Clifton, Jr. on Jan. 26, 2001.

STATEMENT REGARDING FEDERALLY SPONSORED RESEARCH AND DEVELOPMENT

Not Applicable.

REFERENCE TO A MICROFICHE APPENDIX

Not Applicable.

BACKGROUND OF THE INVENTION

1. Field of the Invention

This invention generally relates to handgun holsters and more particularly a holster with improved features to prevent inadvertent dislodgement, rotation, or withdrawal of the handgun from the holster. The holster is designed to retain the handgun securely and yet to permit rapid withdrawal when required.

2. Prior Art

Most attacks on police officers by assailants trying to remove officer's handguns from holsters have come from the front or side of officers and not from the rear. It is obvious that an assailant has more mechanical leverage as well as an unobstructed path by simply pulling forward and up on the handle of the weapon while standing in front facing the officer or facing him at his side.

Most securing straps of holsters might become unlocked in a violent attack. Because of this possibility, an internal locking method is incorporated in some of the prior art holsters to make it more difficult for the attacker to remove the handgun from the holster in an attack from the rear of the officer. Generally, the internal locking means engages the back recurve of the trigger guard or the top ledge of a cylinder of a revolver. In more recent times the popularity of the semiautomatic pistol has posed a problem in the design of a secure holster because this type of handgun has no cylinder ledges nor trigger guard recurves to serve as a locking point. An attempt to lock upon the forward portion of the trigger guard is not preferred because only a few models of semiautomatics offer a flat ledge at the forward portion of the trigger guard necessary for the locking action.

What is needed is an improved handgun holster which overcomes the deficiencies of the prior art, and is designed to provide a holster which secures the handgun from withdrawal by any but the wearer and yet permits a fast withdrawal upwardly by one trained in using the holster. Further, a holster is needed that provides obstacles to one attempting an unauthorized withdrawal of the handgun from the front or side of the holster.

In addition, an improved holster requires a locking mechanism that prevents rotation of a weapon in the holster, which could dislodge the locking action therein.

In addition, a need exists for apparatus that provides a way to allow a user to rapidly reholster a gun securely and quickly if it is not needed in a particular circumstance. For example, a user may draw a gun and find that deadly force is not required and that hand-to-hand action will suffice against a criminal suspect. A user would then need to rapidly reholster the gun without looking but still have the gun secured by a fast acting, self-locking apparatus in a manner that greatly inhibits its grasp by an assailant.

BRIEF SUMMARY OF THE INVENTION

In one aspect of the present invention there is provided an automatic locking holster comprising a quick release withdrawal restraint, an inner and outer sidewall joined together along front and back portions and sidewalls having interior surfaces defining an inner cavity having an open top shaped to fit a handgun holsterable therein. The restraint includes first blocking means located in the inner cavity to engage a portion of a handgun in the holster to inhibit withdrawal of a handgun upwardly prior to rearward movement of a handgun and second blocking means mounted adjacent the rear portion movable between a first position that engages a portion of a handgun to inhibit rearward movement of a handgun and a second position that permits rearward movement of a handgun to withdraw same from the holster. There is third blocking means located in the cavity adjacent a handgun holstered therein to prevent movement of a holsterable handgun to cause movement of the second blocking means from the first position.

The third blocking means includes a blocking member located between one of the interior surfaces and a portion of a holsterable handgun. The third blocking means also includes biasing means located between one interior surface and the second blocking means for maintaining the second blocking means in the first position until the second blocking means is selectively moved. The biasing means includes spring means to apply force to the second blocking means to bias the second blocking means in the first position. The second blocking means includes a body member and the spring means is located between one of the interior surface of one of the sidewalls and the body member.

The third blocking means includes a horizontally disposed post having opposite end portions located between one of the interior surfaces of one of the sidewalls and a portion of a holsterable handgun. Alternatively, the third blocking means may include an elongate post having an elongate body member and a planar head portion, the head portion being adjacent one of the interior surfaces of one of the sidewalls, the third blocking means further including a spring having opposite end portions and a hollow therein, the spring being located between the head portion and the second blocking means. The post is located inside the hollow of the spring for locating the post closely adjacent a portion of a holsterable handgun. One end portion of the spring is engaged with the head portion of the post to bias the head portion against one interior surface of one sidewall. In addition, the body member of the second blocking means is disposed between the one interior surface of one sidewall and a handgun holsterable in the holster, and having an opening extending therethrough to accommodate the post and to permit contact between one of the end portions of the post and a portion of a handgun holsterable in the holster.

In another aspect of the invention, there is provided an automatic locking holster comprising a quick release withdrawal restraint, an inner and outer sidewall joined together along front and back portions, the sidewalls having interior surfaces defining an inner cavity having an open top shaped to fit a handgun and its trigger guard holsterable therein, the restraint including first blocking means located in the inner cavity to engage a portion of a handgun in the holster to inhibit withdrawal of a handgun upwardly prior to rearward movement of a handgun, second blocking means mounted adjacent the rear portion movable between a first position that engages a portion of a handgun to inhibit rearward movement of a handgun and a second position that permits rearward movement of a handgun to withdraw same from the holster. The second blocking means includes a body member having a portion generally parallel to one of the interior surfaces of the inner sidewall, the portion of the body member and one of the interior surfaces of the outer sidewall forming a channel for receiving a trigger guard of a holsterable handgun. Third blocking means is located in the cavity adjacent a trigger guard of a handgun holstered therein to prevent movement of such handgun to cause movement of the second blocking means from the first position. The third blocking means includes a blocking member located between one interior surface and a portion of a holsterable handgun. The third blocking means includes biasing means located between one interior surface and the second blocking means for maintaining the second blocking means in the first position until the second blocking means is selectively moved.

The holster further includes an elongated restraining strap having opposite ends and a medial portion bridging the sidewalls across the open top, means for pivotal attachment of the opposite ends of the strap to the respective sidewalls to permit movement of the strap from a position across the open top to restrict handgun withdrawal to a position generally forwardly of the holster to permit handgun withdrawal, the means for pivotal attachment for preventing forward pivotal movement of the restraining strap until the strap is moved at the means for pivotal attachment in a predetermined direction. There is also selectively operable blocking means attached to the holster movable between a first position to prevent forward pivotal movement of the strap after the strap has first been moved in the downward direction and a second position to allow forward pivotal movement of the strap after the strap has been moved in the downward direction. The third blocking means includes a horizontally disposed post having opposite end portions located between one interior surface of one of the sidewalls and a portion of a holsterable handgun. The third blocking means may also include an elongate post having an elongate body member and a planar head portion, the head portion being adjacent one of the interior surfaces of one of the sidewalls, the third blocking means further including a spring having opposite end portions and a hollow therein. The spring is located between the head portion and the second blocking means, the post being located inside the hollow of the spring for locating the post closely adjacent a portion of a holsterable handgun. One end portion of the spring is engaged with the head portion of the post to bias the head portion against the interior surface of one sidewall. The third blocking means includes a blocking element positioned horizontally between one interior surface of one sidewall and a trigger guard of a handgun.

The first blocking means includes stop means including an inwardly disposed boss having a front-end portion and a rear end portion. The front-end portion of the boss is shaped to engage an inner surface of an ejection port of a handgun to inhibit upward movement of a handgun.

In a further aspect of the present invention there is provided an automatic locking holster comprising a quick release withdrawal restraint, an inner and outer sidewall joined together along front and back portions, the sidewalls having interior surfaces defining an inner cavity having an open top shaped to fit a handgun having a trigger guard holster therein. The restraint includes first blocking means located in the inner cavity to engage a portion of a handgun in the holster to inhibit withdrawal of a handgun upwardly prior to rearward movement of a handgun, second blocking means including a body member mounted adjacent the rear portion movable between a first position that engages a portion of a handgun to inhibit rearward movement of a handgun and a second position that permits rearward movement of a handgun to withdraw same from said holster. The body member has a channel therein for locating a portion of a trigger guard of a handgun holsterable in the holster to prevent removal of a handgun holstered in the holster unless the body member is in the second position. A third blocking means is located in the cavity adjacent a handgun holstered therein to prevent movement of a handgun in a manner to cause movement of the second blocking means from the first position.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description, taken in connection with the accompanying drawings, in which:

FIG. 16 is a diagram illustrating the engagement point of the assembly of FIG. 15 with the trigger guard of a handgun in a holster;

FIG. 17 is a perspective view of the assembly of FIG. 15;

DETAILED DESCRIPTION OF THE INVENTION

The present invention incorporates features of previous patents and co-pending applications of one or both of the present inventions.

1. The present holster employs the biasing apparatus of Rogers, et al '239 to force a handgun forwardly to position the ejection port of a semi-automatic handgun against a stop in the holster. Once seated in this manner, the gun cannot be withdrawn in a simple vertical manner. Rather, the gun must be forced rearwardly against the biasing means to remove it from the stop means. The stop means is removable in the event it becomes worn down so that a new stop means may be inserted. In addition, the stop means is replaceable by another stop means more appropriate to the handgun being used. In the present invention, the stop means is specifically designed to work with a Glock handgun. If the holster is to be used with another type of handgun, the stop means can be easily replaced with one that provides a better match for the handgun actually being used.

2. The present invention may employ the bridging strap of Rogers, et al '381. The bridging strap rides over the rear of a handgun and includes a hood that is rotatable forwardly thus allowing the gun to be withdrawn. The hood is connected to a vertically movable leg member that must be depressed downwardly to allow for rotation of the hood forwardly.

3. The present holster may also include the hood blocking means of Rogers, et al application '085. A positive locking means is positionable in a manner to prevent downward movement of the leg member unless a blocking member is rotated rearwardly out of the way. Because the blocking member must be rotated rearwardly to allow the leg member to be moved downwardly the required action makes it very difficult for an assailant to withdraw the gun. When used with the biasing element and stop means as discussed above even greater security is achieved.

4. The present holster is designed to be used with the improved holster back plate disclosed in Rogers, et al—appl. Ser. No. 09/696,561. The back plate cooperates with a holster belt to prevent movement of the holster forwardly and rearwardly along the belt. This feature includes greater assurance that the holster remains where the user sets it and provides the security of knowing precisely where the accompanying handgun is located.

5. The present holster provides for an alternative to the rear strap used in Rogers '980. The strap used therein operates to hold the rear of the holster—shaped like a clam shell—to be held tightly together providing additional security against assailant withdrawal.

Figure 1:
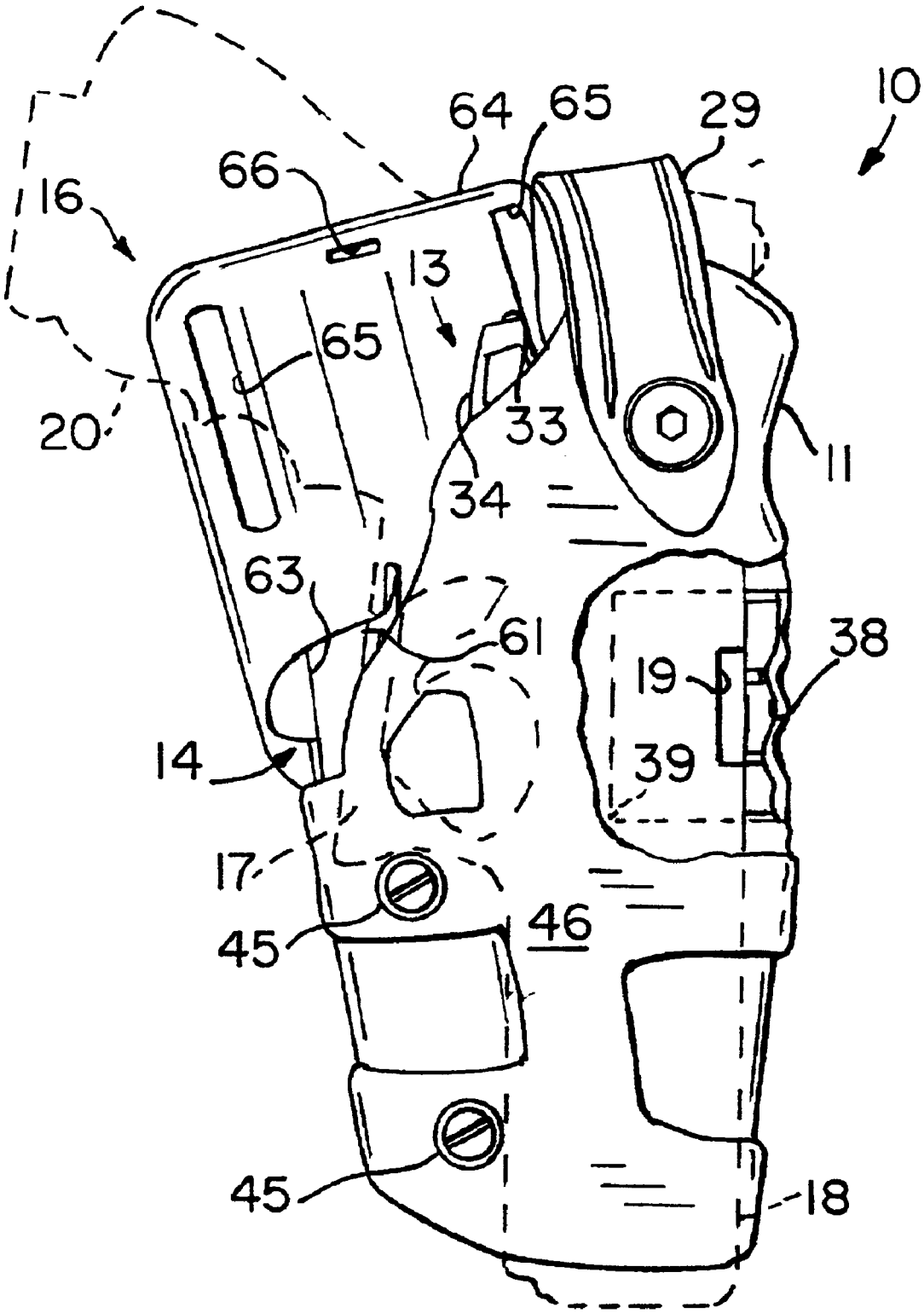
FIG. 1 is a side view of the holster according to the present invention with a portion cut away to illustrate the space used to secure stop means to the holster.
Figure 2:
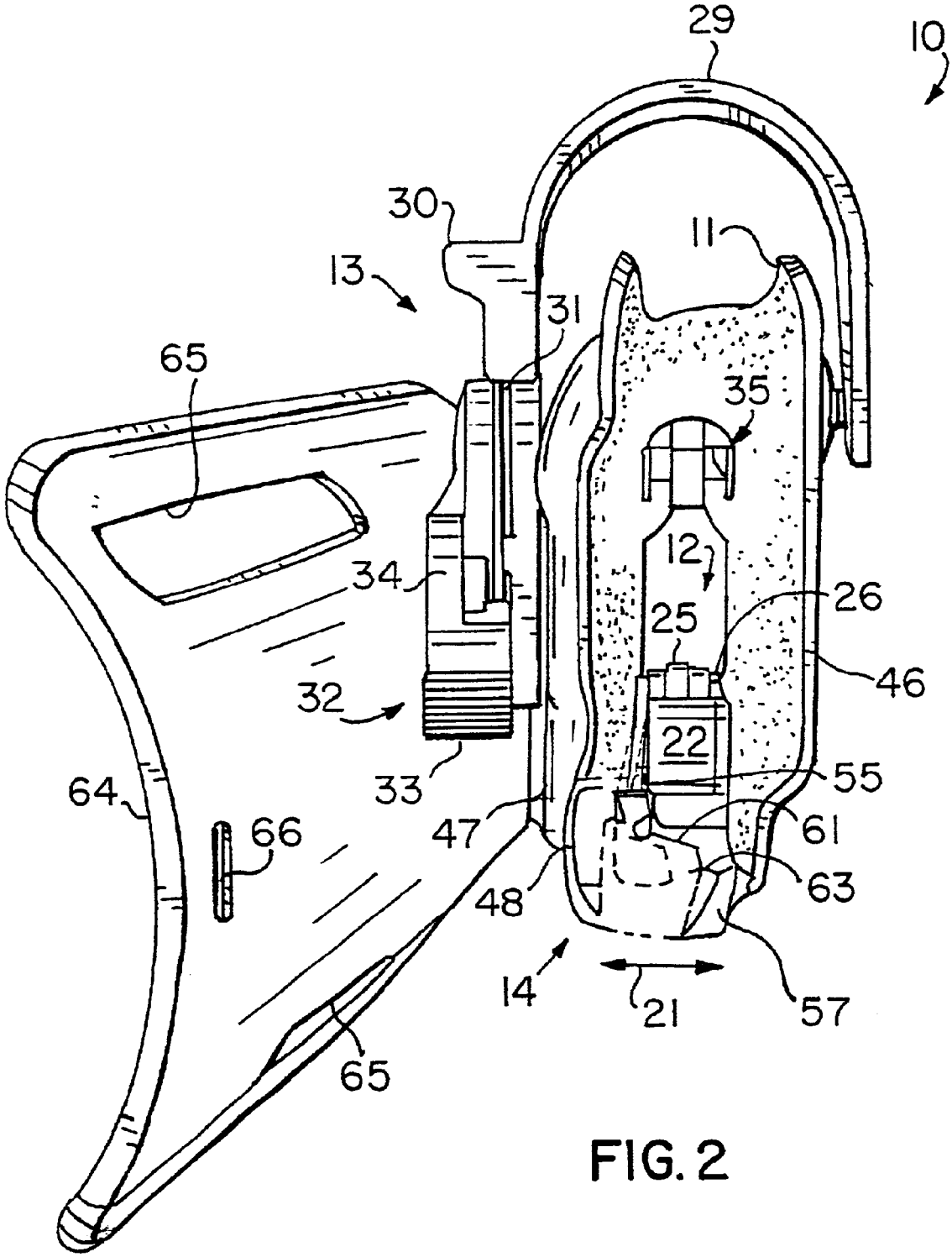
FIG. 2 is a top view of the holster of FIG. 1.
Figure 3:
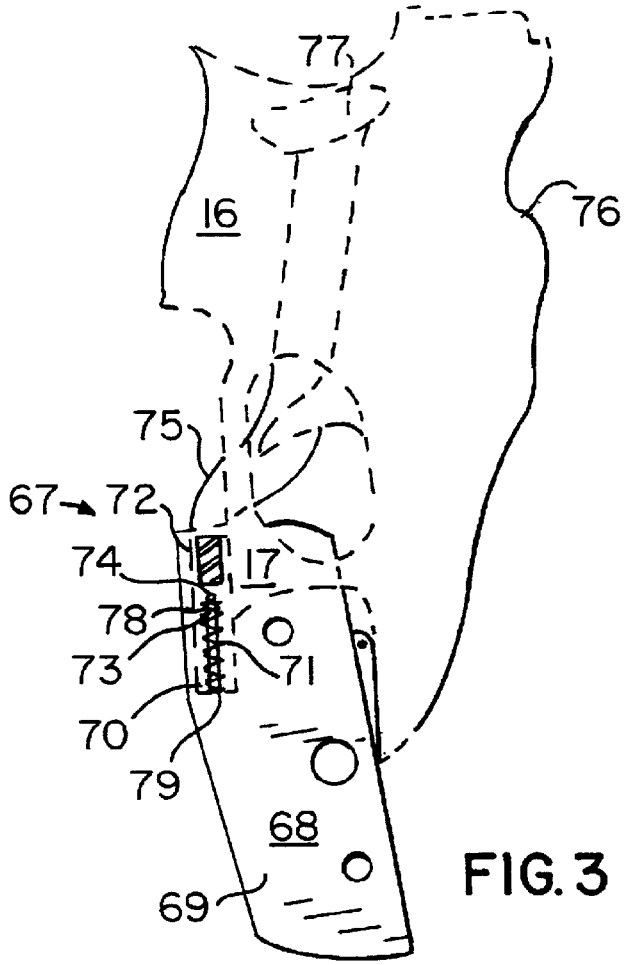
FIG. 3 is a perspective of an alternate embodiment of the rearward securing assembly of FIG. 1.

With reference now to the drawings, FIGS. 1 and 2 illustrate at numeral 10 a side view and rear view respectively of the holster 11 in accordance with the present invention. Biasing apparatus 12 forces a handgun 16 (shown in dotted line in FIG. 1) forwardly against stop means 15 (shown only generally in FIG. 2).

Hood strap assembly 13 is shown up in FIG. 1 and rotated forwardly in FIG. 2. The rearward securing assembly is shown generally at 14 and is movable inwardly (in broken line) from its normal position (shown in solid line) as indicated by arrow 21.

Figure 6:
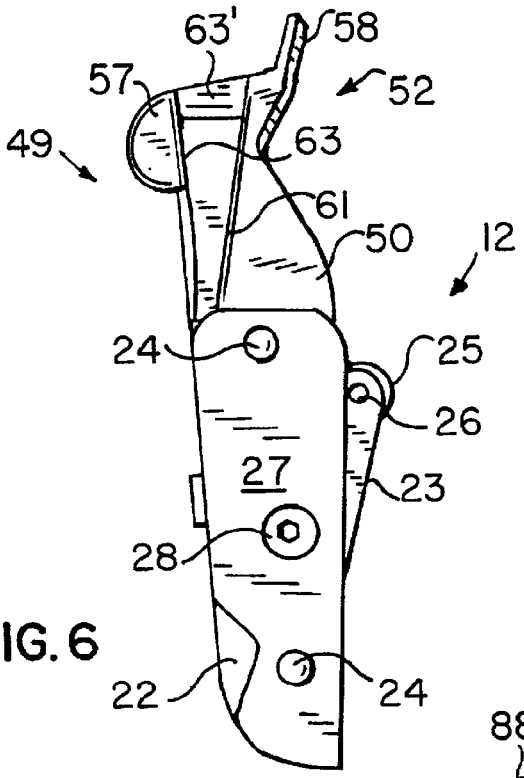
FIG. 6 is a side elevational view of the rearward securing assembly of FIG. 1 shown attached to the biasing assembly.

With reference to FIGS. 1 and 6, forward biasing means 12 includes a support body 22 by which the apparatus 12 is attached to holster 11. An engaging member 23 is pivotally mounted via pin 24. Member 23 carries a roller 25 mounted on axle 26 and is internally spring biased to be forced against trigger guard 17. Flange 27 provides for mounting body 22 to holster 11 via a T-nut 28 or other appropriate means as illustrated in U.S. Pat. No. 5,944,239 incorporated herein by reference. With respect again to FIG. 2, hood strap assembly 13 includes hood strap 29 having a thumb ledge 30 by which leg 31 can be pushed downwardly to allow for strap 29 to be rotated forwardly as shown once the locking mechanism is cleared as clearly illustrated in U.S. Pat. No. 5,501,381 which is herein incorporated by reference.

Releasable blocking apparatus 32 includes a thumb ledge 33 by which a blocking element 34 can be moved rearwardly to allow leg 31 to be pushed downwardly as clearly illustrated in appl. Ser. No. 09/562,085 which is herein incorporated by reference.

Figure 4:
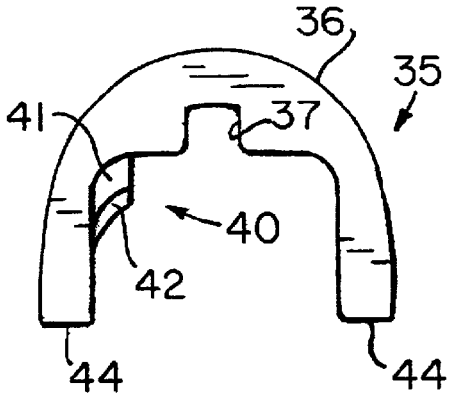
FIG. 4 is a cross-section of the stop means used in the holster.
Figure 5:
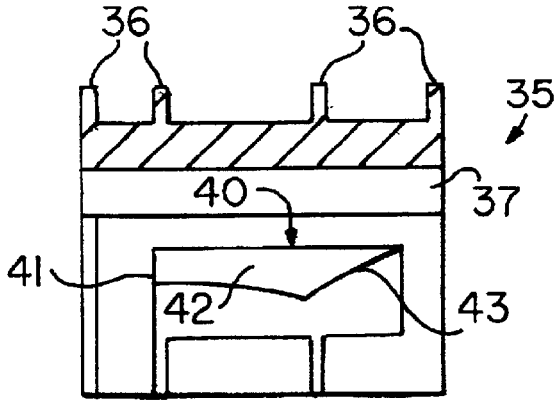
FIG. 5 is a front elevational view of the stop means of FIG. 4.

FIGS. 4 and 5 illustrate the preferred stop means used in the present invention. Stop means insert 35 includes a series of ribs 36 that match curved interior channel 38 in holster 11 resting on ledges 39 (FIG. 2) which fixes it in place when the holster is closed with screws 45. Interior upper channel 37 provides clearance for the forward sight 18 of a handgun 16. Boss 40 includes three portions: a first flat portion 41 fits into the forward portion of an ejection port 19; and second and third portions 42 and 43 that "cam up" or guide the muzzle of a handgun 16 when it is inserted into the holster 11. Biasing apparatus 12 also engages the gun, forcing it upwardly against the forward portion of the holster 11 providing that boss 40 fits into port 19. Direct rearward (i.e., vertical) movement of the handgun 16 will be blocked by the forward part of the gun 16 adjacent the forward edge of port 19 coming into contact with front portion 41 of boss 40. Accordingly, rearward motion of the gun 16 against biasing apparatus 12 is required to clear boss 40 and remove the gun 16 from holster 11.

As also shown in FIG. 2, stop means 35 is a unitary plastic element that fits into interior space 38 and is secured into position when screws 45 are tightened to close the holster 11 without any additional mechanical means and is therefore easily replaceable. The holster 11 is held together rearwardly in a clamshell-like fashion via screws 45 that provide for sufficient closure of the holster side 46 and the two inward overlapping sidewall portions 47 and 48. Portion 47 is unitary with side 46 and is formed to overlie portion 48 to further provide for security against gun 16 being withdrawn by an assailant a rearward engaging means 14 is employed to prevent rearward movement of the gun 16 unless a blocking element 49 is pushed inwardly and out of the way of the trigger guard 17 by a user.

Figure 7:
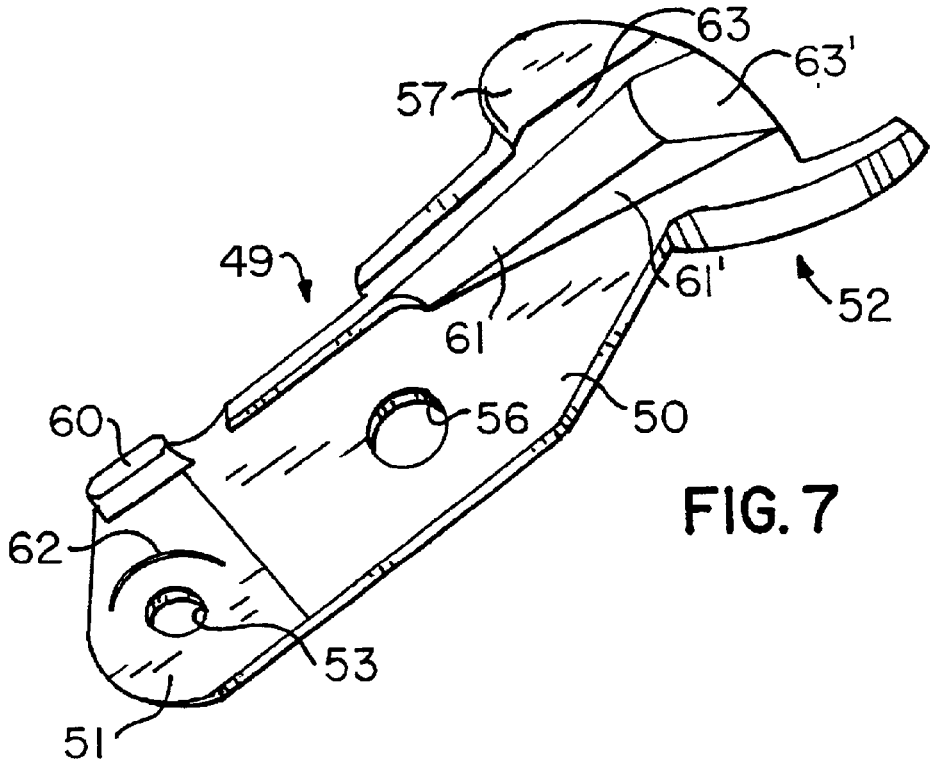
FIG. 7 is a perspective view of the blocking member employed in FIG. 6.
Figure 8:
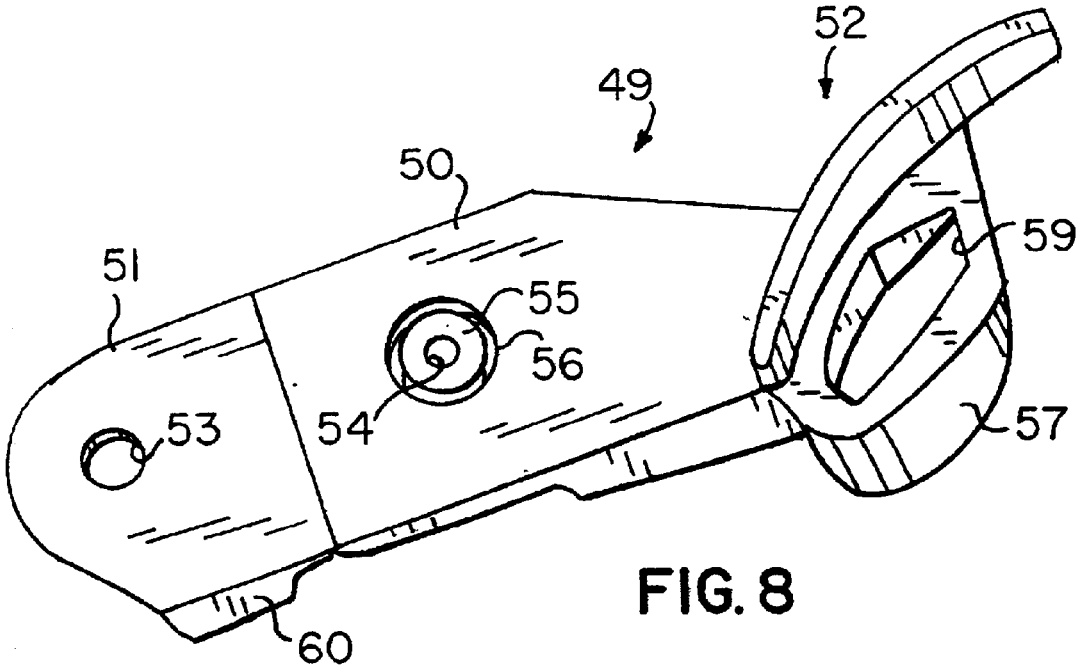
FIG. 8 is another perspective view of the blocking member of FIG. 7.

The blocking element is shown in FIGS. 7–8. Element 49 includes a body 50 having a first end portion 51 to which it is mounted to biasing member body 22 using pin 24 and a second end portion 52 including a finger ledge 57 by which it is moved sideways with a middle finger preferably, or an index finger.

First end portion 51 includes pin (or screw) hole 53 by which it is rigidly attached to body 22. Another medially located hole 56 in body 22 fits over laterally extending post 55 mounted on body 27. Hole 54 provides a passageway for a screw or bolt 45 mounting biasing assembly 12. Flange 58 extends laterally and aids in blocking debris from entering the holster 11 and the associated securing apparatus such as the pivot means. Cavity 59 in ledge 57 reduces weight. Rib sections 60 and 62 cooperate with the specific embodiment of biasing apparatus 12 used in the holster 11. Rib 61 is preferably in contact with trigger guard 17. The rib 61 is upraised to fit forwardly of ledge 57 against trigger guard 17 to minimize the allowed rearward movement of handgun 16 before the movement is blocked. When blocking element 49 is moved sideways by finger pressure on ledge 57, rib 61 is moved away from trigger guard 17 and sufficient room will exist between adjacent flange 63 and surface 63' to allow enough to allow enough rearward movement of the handgun 16 to disengage the ejection port 19 from stop means boss 40 but not enough movement to allow the gun 16 to clear the rotating hood 29 if the hood 29 is upward in its blocking position.

FIG. 6 illustrates an alternative embodiment of a rearward securing assembly 67. Biasing assembly 68 is substantially the same as the assembly 12. Housing 69 provides space 70 for spring 71 and guard block 72 that is normally biased to be in contact with trigger guard 17. Vertical channel 73 is also formed in housing 69 and provides a travel path for holding pin 74 by which block 72 is mounted to spring 71. Trigger guard arm 75 extends upward on the inward (user's) side of holster 76 and terminates in thumb ledge 77. Downward pressure on ledge 77 pushes guard block 72 downwardly in space 70 below trigger guard 17 allowing for rearward motion of gun 16 as before. Spring 71 mounted being locating elements 78 and 79.

Figure 10:
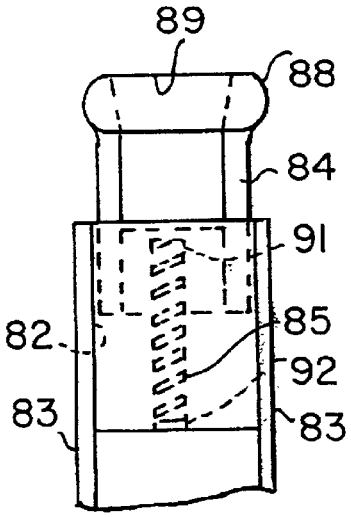
FIG. 10 is a rear view of the guard block of FIG. 9.
Figure 9:
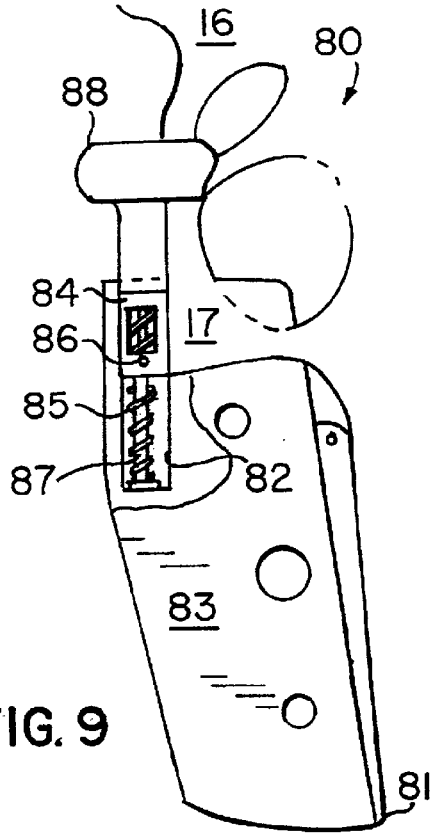
FIG. 9 is a side elevational view of another embodiment of the rearward securing assembly.

FIGS. 9 and 10 illustrate another embodiment of a rearward securing assembly 80. Biasing assembly 81 is substantially as before and includes a space 82 in housing 83 in which guard block 84 is mounted on spring 85 via pin 86 which moves in vertical channel 87. Finger ledge 88 is used to depress block 84 downwardly to allow rearward movement of trigger guard 17 for withdrawal of gun 16 as before.

Finger ledge 88 is formed with a medially located channel 89 to keep ledge 88 close to the gun 16 for close to the handgun 16 for increased safety. Spring locating elements 91, 92 are as before.

To summarize, when handgun 16 is inserted into the holster 11 the tapered portion of stop 15 results in an angled entry of the muzzle with the trigger guard 17 rearwardly. As the handgun 16 is inserted further, biasing means 12 begins to force handgun 16 forwardly as trigger guard 17 makes contact with rear securing means 14 at a rearward portion of cam or flange surface 63' and the trigger guard pushes the blocking element 49 inwardly out of the way to permit handgun 16 to become fully seated, whereupon the blocking element 49 by surface 61' of rib 61 engages the trigger guard 17 to prevent rearward movement and to automatically lock the gun in the holster. Further securing is accomplished by rotating hood 29 over the handgun 16 and further securing by hand lock-blocking element 34.

Figure 11:
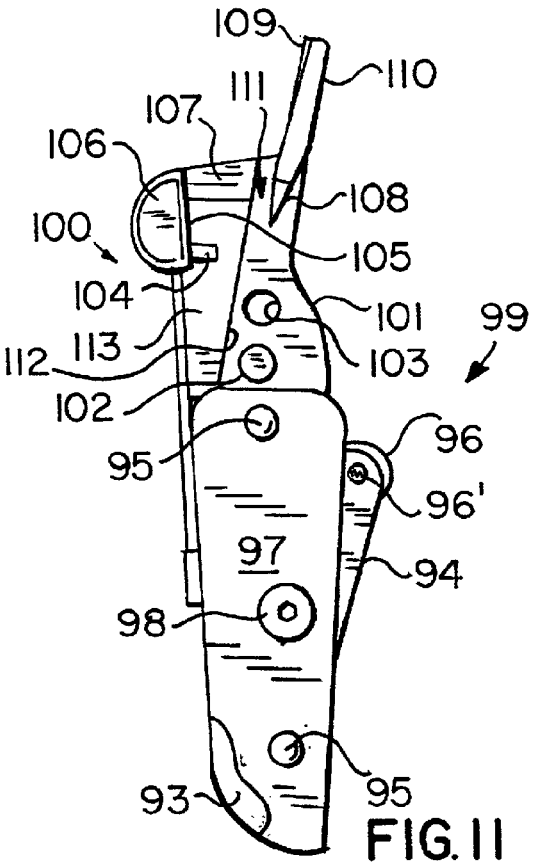
FIG. 11 is a side elevational view of an alternate embodiment of the rearward securing assembly in accord with the present invention.

With respect to FIG. 11, forward biasing member 99 is comprised of support body 93, engaging member 94, pins 95, roller 96 mounted on axle 96', flange 97 carrying T-nut 98 all substantially identical to the prior members. The mechanical blocking element 100 has been modified to prevent rotation or twisting of a handgun that could be sufficient to dislodge the gun from the rearward securing assembly 14 (FIGS. 1–2). Body 101 includes a laterally extending post 102 and a boss 104 both of which will engage a trigger guard, and hole 103 for a post, which will be described hereinbelow. Flange 105 finger ledge 106 and surface 107 are as before as is rib 112.

Flanges 109 and 110 are modifications of the apparatus of FIG. 6 to provide a channel 111 to hold a gun trigger guard therein. The trigger guard is guided by flange 109 and abuts rib 112 and post 102. The curvature of flange 108 provides an engaging surface for a gun trigger.

Figure 12:
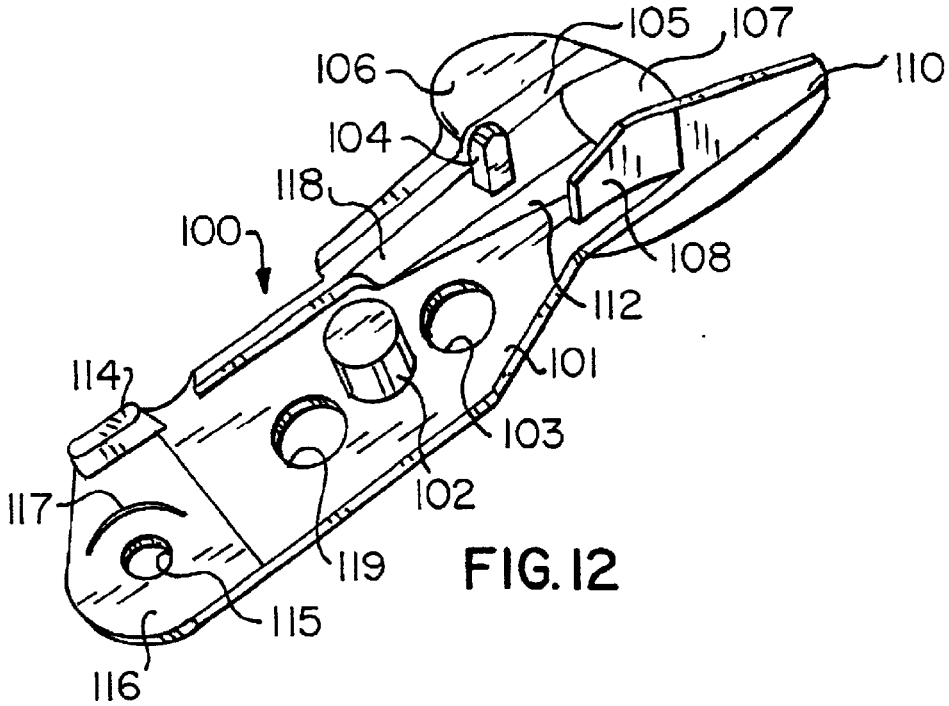
FIG. 12 is a perspective view of the assembly of FIG. 11.

Flange 97 is shown removed in FIG. 12 and illustrates that lower end 116 of body 101 includes ribs 113 and 114, holes 115 and 119 and flange surface 118 are as before.

Figure 13:
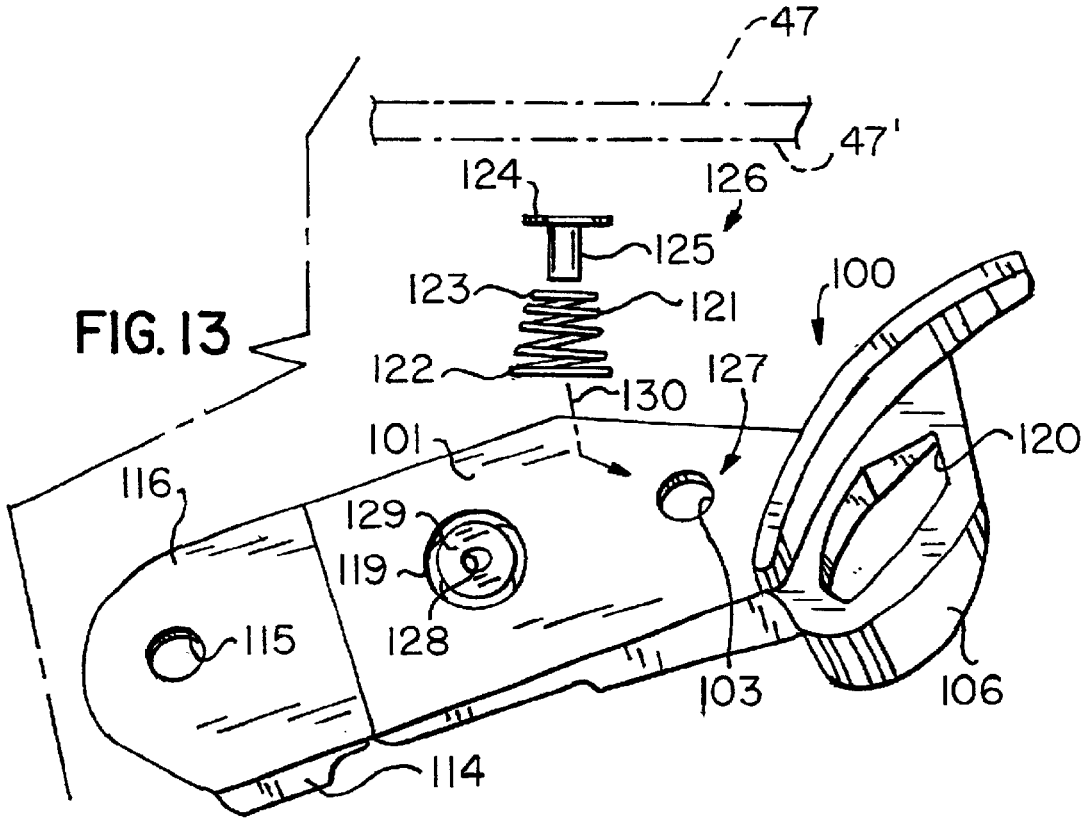
FIG. 13 is another perspective view of the assembly of FIG. 11 showing the anti-rotation apparatus in accord with the present invention.

The reverse of element 100 is shown in FIG. 13 and illustrates anti-rotation apparatus 126, which consists of two parts: spring 121 and post 125. Post 125 has top head 124 and fits into smaller upper end 123 of spring 121, which mounts head 124 against inside surface 47' of sidewall 47. Larger diameter lower end 122 rests on a portion 127 of body 101 adjacent post hole 103 as indicated by arrow 130. Post 129, T-nut hole 128 and cavity 120 are as before.

Figure 14:
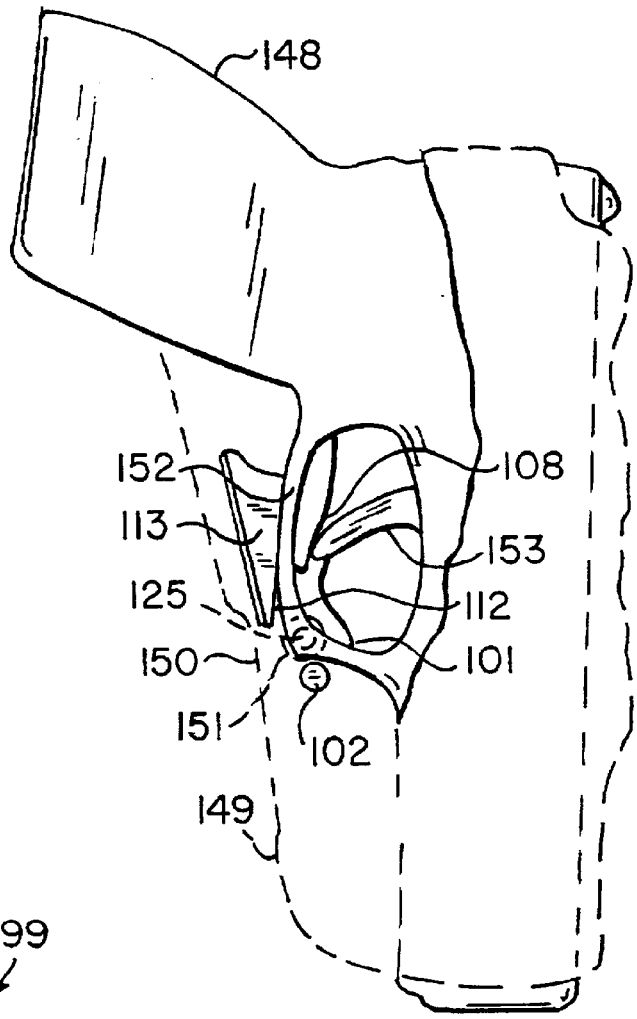
FIG. 14 is a partial diagrammatic view of the assembly of FIGS. 11–13 in use securing a handgun in a holster.

With regard also to FIG. 14, post head 124 is held against the inside surface 47' of a holster sidewall 47 of holster 149 (shown in dotted line). Excessive lateral movement or rotation of a gun 148 is prevented by the engagement of post 125 with the trigger guard 150 at the area shown in broken line 151.

The relative positions of post 102 and rib portion 152 of trigger guard 150 which fits into channel 111 is shown in solid line. The rest of apparatus 100 is not shown for purposes of clarity.

Accordingly, gun 148 cannot be moved in a manner to force apparatus 100 out of a locked position into, for example a release position by twisting or other movement.

Figure 15:
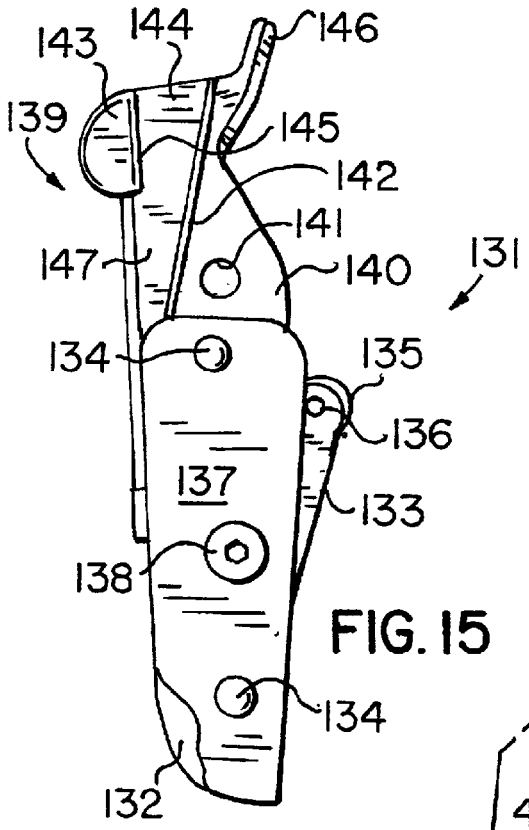
FIG. 15 is a side elevational view of an alternative embodiment of the rearward securing apparatus in accord with the present invention.

With regard to FIGS. 15, 16, and 17, forward biasing member 131 includes body 132, engaging member 133, pins 134, roller 135, axle 136, flange 137, and T-nut 138 all of which are substantially identical to the apparatus previously described hereinabove.

Mechanical blocking element 100 is substantially identical to element 49 of FIG. 6 with the exception of post hole 141 to accommodate a post 125 as part of apparatus 126. Body 140 includes flange 142, finger ledge 143, surface 144, flanges 145 and 146, and rib 147.

Figure 18:
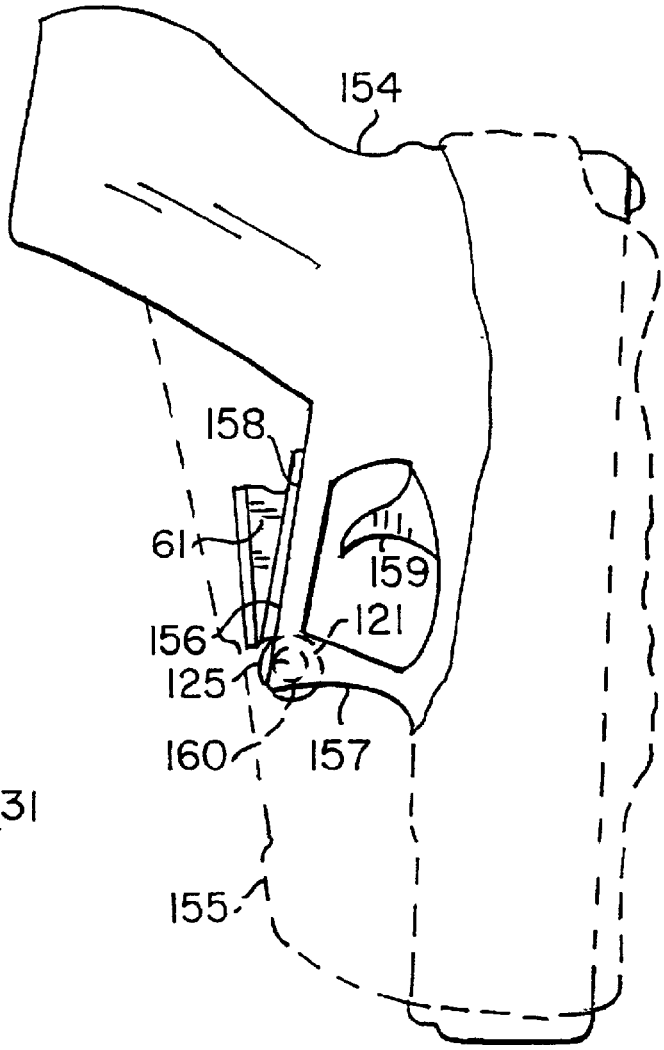
FIG. 18 is a partial diagrammatic view of the assembly of FIGS. 15–17 in use securing a handgun in a holster.
Figure 19:
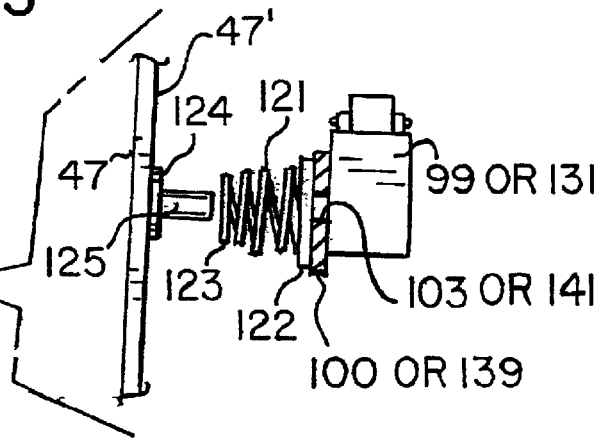
FIG. 19 is a partial cross-sectional exploded diagram showing the relative positioning of the components of the anti-rotation blocking device according to the present invention.

With regard to FIG. 18, gun 154, mounted in holster 155, has a slightly different form of trigger guard 156 having a substantially straight lower rib 158, curved front end 157. Trigger 159 is also slightly different.

The anti-rotation apparatus used here is identical to apparatus 126 (FIG. 13) and is identically mounted. Post 125 engages area 160 (shown in broken line) spring end 122 rests against body portion 162 via arrow 161. Here as in FIGS. 11–14, the post 125 engagement will prevent movement of element 139 by rotation or twisting of gun 154 to dislodge the gun 154 from the holster 155 by moving the rearward securing apparatus 14 out of the locked position.

In both embodiments spring 121 provides force against blocking element body 101, 140 to bias the body 101, 140 to the locked position and provide further security against withdrawal of a respective handgun 148, 154 until the proper steps for release are taken.

Rotating hood is illustrated in FIGS. 1 and 2 but is not required for use with anti-rotation blocking apparatus 126.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An automatic locking holster comprising a quick release withdrawal restraint, an inner and outer sidewall joined together along front and back portions, said sidewalls having interior surfaces defining an inner cavity having an open top shaped to fit a handgun holsterable therein, said restraint including first blocking means located in said inner cavity to engage a portion of a handgun in said holster to inhibit withdrawal of a handgun upwardly prior to rearward movement of a handgun, second blocking means mounted adjacent said rear portion movable between a first position that engages a portion of a handgun to inhibit rearward movement of a handgun and a second position that permits rearward movement of a handgun to withdraw same from said holster, and third blocking means located in said cavity adjacent a handgun holstered therein to prevent movement of a holsterable handgun to cause movement of said second blocking means from said first position.

2. The holster as defined in claim 1 wherein said third blocking means includes a blocking member located between one of said interior surfaces and a portion of a holsterable handgun.

3. The holster as defined in claim 1 wherein said third blocking means includes a blocking element positioned horizontally between one said interior surface of one said sidewall and a trigger guard of a handgun.

4. The holster as defined in claim 1 wherein said third blocking means includes biasing means located between one said interior surface and said second blocking means for maintaining said second blocking means in said first position until said second blocking means is selectively moved.

5. The holster as defined in claim 4 wherein said biasing means includes spring means to apply force to said second blocking means to bias said second blocking means in said first position.

6. The holster as defined in claim 5 wherein said second blocking means includes a body member, said spring means located between one of said interior surfaces of one of said sidewalls and said body member.

7. The holster as defined in claim 1 wherein said third blocking means includes a horizontally disposed post having opposite end portions located between one of said interior surfaces of one of said sidewalls and a portion of a holsterable handgun.

8. The holster as defined in claim 7 wherein said body member of said second blocking means is disposed between said one interior surface of said one sidewall and a handgun holsterable in said holster, said body member of said second blocking means having an opening extending therethrough to accommodate said post and to permit contact between one of said end portions of said post and a portion of a handgun holsterable in said holster.

9. The holster as defined in claim 1 wherein said third blocking means includes an elongate post having an elongate body member and a planar head portion, said head portion being adjacent one of said interior surfaces of one said sidewalls, said third blocking means further including a spring having opposite end portions and a hollow therein, said spring being located between said head portion and said second blocking means, said post being located inside said hollow of said spring for locating said post closely adjacent a portion of a holsterable handgun.

10. The holster as defined in claim 9 wherein one said end portion of said spring is engaged with said head portion of said post to bias said head portion against said one interior surface of said one sidewall.

11. An automatic locking holster comprising a quick release withdrawal restraint, an inner and outer sidewall joined together along front and back portions, said sidewalls having interior surfaces defining an inner cavity having an open top shaped to fit a handgun and its trigger guard holsterable therein, said restraint including first blocking means located in said inner cavity to engage a portion of a handgun in the holster to inhibit withdrawal of a handgun upwardly prior to rearward movement of a handgun, second blocking means mounted adjacent said rear portion movable between a first position that engages a portion of a handgun to inhibit rearward movement of a handgun and a second position that permits rearward movement of a handgun to withdraw same from said holster, said second blocking means including a body member having a portion generally parallel to one of said interior surfaces of said inner sidewall, said portion of said body member and one of said interior surfaces of said outer side wall forming a channel for receiving a trigger guard of a holsterable handgun, and third blocking means located in said cavity adjacent a trigger guard of a handgun holstered therein to prevent movement of such handgun to cause movement of said second blocking means from said first position.

12. The holster as defined in claim 11 wherein said third blocking means includes a blocking member located between one said interior surface and a portion of a holsterable handgun.

13. The holster as defined in claim 11 wherein said third blocking means includes biasing means located between one said interior surface and said second blocking means for maintaining said second blocking means in said first position until said second blocking means is selectively moved.

14. The holster as defined in claim 11 wherein said third blocking means includes a horizontally disposed post having opposite end portions located between one said interior surface of one of said sidewalls and a portion of a holsterable handgun.

15. The holster as defined in claim 10 wherein said first blocking means includes stop means, said stop means including an inwardly disposed boss having a front end portion and a rear end portion, said front end portion of said boss being shaped to engage an inner surface of an ejection port of a handgun to inhibit upward movement of a handgun, for restricting movement of a handgun in a substantially vertical plane only when said blocking means moves from said first to said second position.

16. The holster as defined in claim 11 further including an elongated restraining strap having opposite ends and a medial portion bridging said sidewalls across said open top, means for pivotal attachment of said opposite ends of said strap to respective said sidewalls to permit movement of said strap from a position across said open top to restrict handgun withdrawal to a position generally forwardly of said holster to permit handgun withdrawal, said means for pivotal attachment for preventing forward pivotal movement of said restraining strap until said strap is moved at said means for pivotal attachment in a predetermined direction.

17. The holster as defined in claim 16 further including selectively operable blocking means attached to said holster movable between a first position to prevent forward pivotal movement of said strap after said strap has first been moved in said downward direction and a second position to allow forward pivotal movement of said strap after said strap has been moved in said downward direction.

18. The holster as defined in claim 11 wherein said third blocking means includes an elongate post having an elongate body member and a planar head portion, said head portion being adjacent one of said interior surfaces of one said sidewalls, said third blocking means further including a spring having opposite end portions and a hollow therein, said spring being located between said head portion and said second blocking means, said post being located inside said hollow of said spring for locating said post closely adjacent a portion of a holsterable handgun.

19. The holster as defined in claim 18 wherein one said end portion of said spring is engaged with said head portion of said post to bias said head portion against said interior surface of said one sidewall.

20. An automatic locking holster comprising a quick release withdrawal restraint, an inner and outer sidewall joined together along front and back portions, said sidewalls having interior surfaces defining an inner cavity having an open top shaped to fit a handgun having a trigger guard holster therein, said restraint including first blocking means located in said inner cavity to engage a portion of a handgun in the holster to inhibit withdrawal of a handgun upwardly prior to rearward movement of a handgun, second blocking means including a body member mounted adjacent said rear portion movable between a first position that engages a portion of a handgun to inhibit rearward movement of a handgun and a second position that permits rearward movement of a handgun to withdraw same from said holster, said body member having a channel therein for locating a portion of a trigger guard of a handgun holsterable in said holster to prevent removal of a handgun holstered in said holster unless said body member is in said second position, and third blocking means located in said cavity adjacent a handgun holstered therein to prevent movement of a handgun in a manner to cause movement of said second blocking means from said first position.

* * * * *